US005351799A

United States Patent [19]

Ibarrola

[11] Patent Number: 5,351,799

[45] Date of Patent: Oct. 4, 1994

[54] TEMPORARY AUTOMATIC MACHINE COIN STORE

[75] Inventor: Jesus E. Ibarrola, Pamplona Navarra Espana, Spain

[73] Assignee: Azkoyen Industrial, S.A., Peralta, Spain

[21] Appl. No.: 838,763

[22] PCT Filed: Jul. 17, 1991

[86] PCT No.: PCT/ES91/00043

§ 371 Date: May 18, 1992

§ 102(e) Date: May 18, 1992

[87] PCT Pub. No.: WO92/02003

PCT Pub. Date: Feb. 6, 1992

[30] Foreign Application Priority Data

Jul. 18, 1990 [ES] Spain ..... 9001946

[51] Int. Cl.[5] ..... G07D 1/00

[52] U.S. Cl. ..... 194/346; 221/84; 453/56

[58] Field of Search ..... 194/246, 343, 352; 221/82, 84, 77; 453/56

[56] References Cited

U.S. PATENT DOCUMENTS

| | | | |
|---|---|---|---|
| 3,938,699 | 2/1976 | Wittern | 221/85 |
| 3,970,217 | 7/2076 | Culbertson | 221/80 |
| 4,214,654 | 7/1980 | Pryor | 194/343 |
| 4,841,563 | 6/1989 | Sano | 194/346 X |

FOREIGN PATENT DOCUMENTS

| | | | |
|---|---|---|---|
| 0369731 | 5/1990 | European Pat. Off. . | |
| 633023 | 7/1936 | Fed. Rep. of Germany . | |
| 3500537 | 7/1986 | Fed. Rep. of Germany | 194/346 |
| 3541869 | 6/1987 | Fed. Rep. of Germany . | |
| 684975 | 7/1930 | France | 194/352 |
| 3-142596 | 6/1991 | Japan | 221/84 |
| 2022897 | 12/1979 | United Kingdom . | |
| 2219681 | 12/1989 | United Kingdom . | |

*Primary Examiner*—F. J. Bartuska
*Attorney, Agent, or Firm*—Helfgott & Karas

[57] ABSTRACT

A temporary automatic machine coin store includes a gear-tooth belt disposed between two tooth-gear blocks, namely, a driving tooth-gear block and a return tooth-gear block. A plurality of blades are attached to one belt. The width of the blades is equal to the maximal diameter of the coin to be inserted. The coin store assembly is disposed inside a vertically elongate housing. The tooth-gear blocks are vertically aligned. The upper end of the housing has a window for the coins to enter. The coins drop one by one upon the dihedral defined by each pair of blades which occupy at that time the upper end position within the device.

3 Claims, 2 Drawing Sheets

TEMPORARY AUTOMATIC MACHINE COIN STORE

BACKGROUND OF THE INVENTION

The present invention relates to an automatic machine coin store, i.e., a store for machines capable upon insertion of a number of coins of providing a product or service, such store being able to house such coins for the time being before ultimately sending the same to the machine's collector box, or returning the same to the user depending on whether or not the machine supplies the product or service at issue.

Modern automatic machines are in addition to an electronic coin selector provided with a programme capable of counting the inserted coins to establish a user "credit" in order to determine refund or change required upon provision of the product or service by the machine, and as appropriate in order to return the full sum of money inserted in the machine in the event that the latter is unable, having run out of the product or otherwise, to suitably meet the request being made to it.

In such events, for instance when the product runs out, the money is returned by the refunders provided for change, wherein the coins worth most are not retained inasmuch as these need never be returned, and thus after a longer or shorter time interval in this position, the machine shall be unable to return any monies unless the product is first restocked or the relevant fault is put right.

SUMMARY OF THE INVENTION

The temporary coin store, subject of the invention, fully solves these problems, inasmuch as in any of the above events it refunds to each user exactly the same coins inserted by the latter, and thus the faulty position can be endlessly maintained without this meaning that the users risk losing their money.

More specifically, and in order to achieve the above objects, the store is made up of a gear-tooth belt, disposed between two end cogwheels, a driving cogwheel and a return cogwheel, attached to the belt including a number of blades, whose width varies according to the maximum diameter of the coins to be inserted, the whole set being disposed within a vertically elongate housing wherein the cogwheels are in a vertical alignment. A window is provided at the upper end of the housing for access of the coins, which drop one by one upon the dihedral constituted by the pair of blades which occupy the upper end position within the device at that time.

The driving cogwheel or block is fitted with a motor-reducer mounted on the outside of the housing, the motor-reducer being an impulse motor such that in each of its impulses, a blade moves forward in regard to the upper window for coin insertion, the motor being capable of turning in either direction.

Finally, and to supplement the above structure, the lower end of the housing has two opposite outlet windows in order that when the belt turns in a given direction, the coins held between the blades will drop outside the housing through one of such windows and through the other when they turn in the opposite direction.

Naturally, with this structure the device can gradually store all the coins inserted by the one user and in the event of the machine providing the product or service requested, will subsequently turn to empty the coins towards the collector box, whilst in the event of the machine being unable to meet the request made, for any reason, the belt will turn in the opposite direction and evacuation will be through the window connected to the coin return set.

The number of blades in the belt will obviously suffice for the maximum number of coins that could foreseeably be inserted to be housed for the time being.

In another more simplified embodiment of the invention, the gear-tooth belt together with the number of blades attached thereto is replaced by a simple rotatory partition attached to the output shaft of the motor-reducer, acting as a platform to collect the group of coins and which will unload toward either outlet window depending on the direction of rotation of the motor, specifically depending upon whether the coins are to be sent to the machine's collector box or to be returned to the user.

BRIEF DESCRIPTION OF THE DRAWINGS

In order to provide a fuller description and contribute to the complete understanding of the characteristics of this invention, a set of drawings is attached to the specification which, while purely illustrative and not fully comprehensive, shows the following:

FIG. 6 is a view similar to that of FIG. 2, but showing the embodiment of FIG. 5; and.

DESCRIPTION OF PREFERRED EMBODIMENTS

Figure 1:
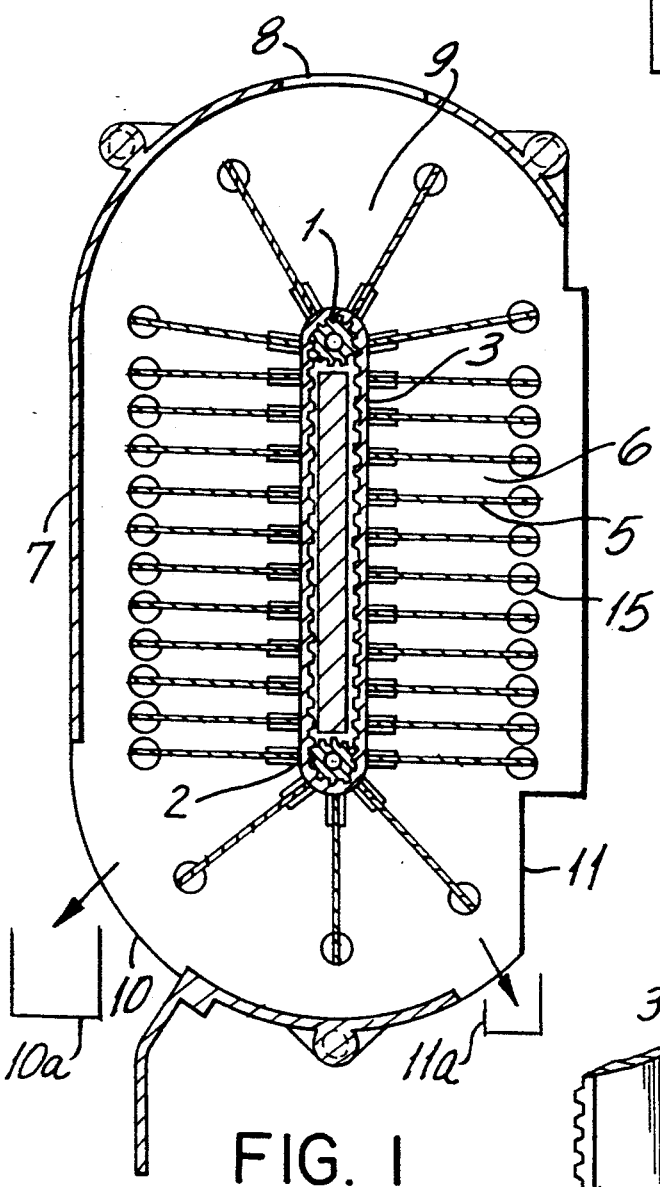
FIG. 1 is a front elevation view of a temporary automatic machine coin store constructed in accordance with the subject of the present invention.

The figures show the temporary automatic machine coin store which is provided with two cogwheels or tooth-gear blocks (1) and (2) between which a corresponding gear-tooth belt (3) is disposed, blocks (1) and (2) remaining within an imaginary vertical plane and one of them, namely the top block, being associated with a motor-reducer group (4) which provide the required movement to the gear-tooth belt (3), which is in turn fitted with a number of blades (5) which therebetween define horizontal spacings (6) where respective coins can be accommodated and retained.

The blade-carrier belt is disposed within a housing (7) which is primarily rectangular in shape, being vertically elongate, but with the upper and lower ends semi-circularly rounded, the upper end area having a window (8) through which the coins drop one by one to the dihedrals (9) defined by the blades (5) as they move past this upper end area of the housing, whereas at the bottom there are two outlet windows (10) and (11) for the coins to be evacuated, one of them preferably fitted with a deflection partition (12). One of the outlet windows (10) opens into a machine collector box (10*a*) and another window (11) opens into a coin refund channel (11*a*).

A motor 4*a* working with the motor-reducer group (4) is an impulse motor which is also able to turn in either direction such that when the machine user inserts a coin therein, the motor shall turn a given number of impulses, as appropriate for the upper dihedral (9), constituted by a pair of adjacent blades (5) to be replaced by the next naturally in order for the various coins inserted by the user to take up the superposed spaces (6) defined by the blades, which blades (5) will obviously be dimensionally suited to accommodate any coin size.

Figure 3:
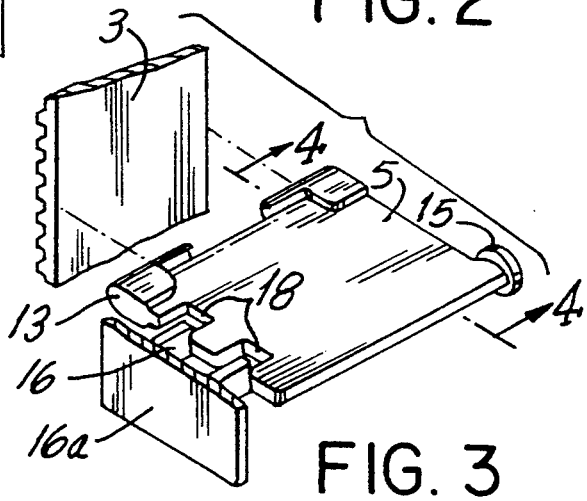
FIG. 3 is an exploded perspective view of one of the blades forming part of the temporary coin store, with the duly opposed gear-tooth belt to which it is attached.

The position of the blades (5) is controlled by a pair of photodiodes (16) duly mounted upon a support (16*a*) mounted to the housing (7). The blades (5) are at one of their lateral edges provided with a pair of notches (18) within which the photodiodes play, as is specifically shown in FIG. 3, such that the beam of light of photodiodes (16) is broken when the photodiodes are crossed by each blade (5).

Once the user of the machine has inserted all the coins, the motor-reducer will turn in either direction in order for the coins to be ejected from the temporary store through the window (10) or the window (11) depending on whether or not the machine has provided the product or service at issue, and hence depending upon whether the coins must be sent to the collector box in the machine or be returned to the user.

Figure 2:
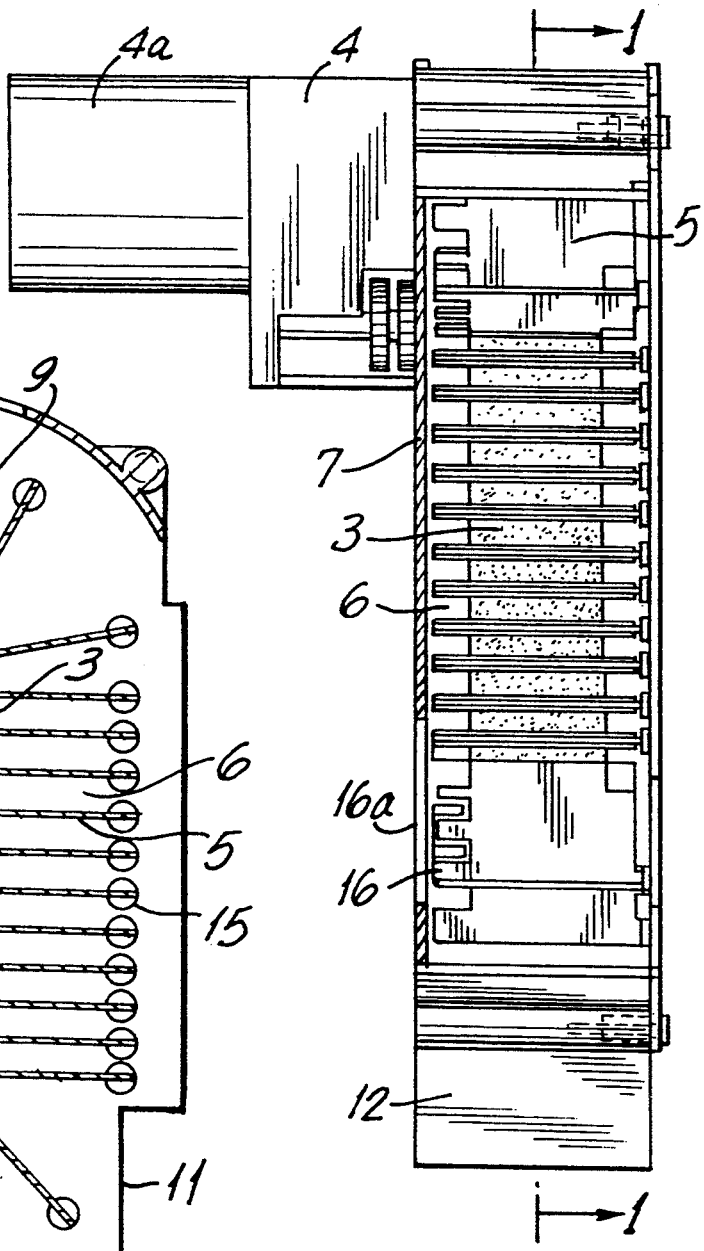
FIG. 2 is a section view taken along line A-B of FIG. 1.
Figure 4:
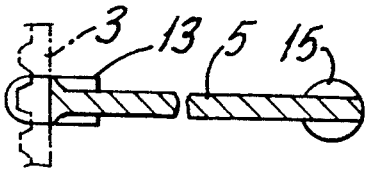
FIG. 4 is a cross-section view of the assembly taken along line C–D of FIG. 3.

Finally, it only remains to be said that in order to suitably fix the blades (5) to the belt (3) at a right angle to the latter, each blade (5) is provided with clips (13) at its front corners for attachment to the actual teeth (14) on the belt, as specifically shown in FIG. 4. The blades (5) are also each provided with a small projection (15) at one of its free corners, which in the practical embodiment of the figure is circular in shape, but could also be shaped otherwise projections 15 are designed to ensure that a minimum space exists between blades, as shown in FIG. 2.

Figure 5:
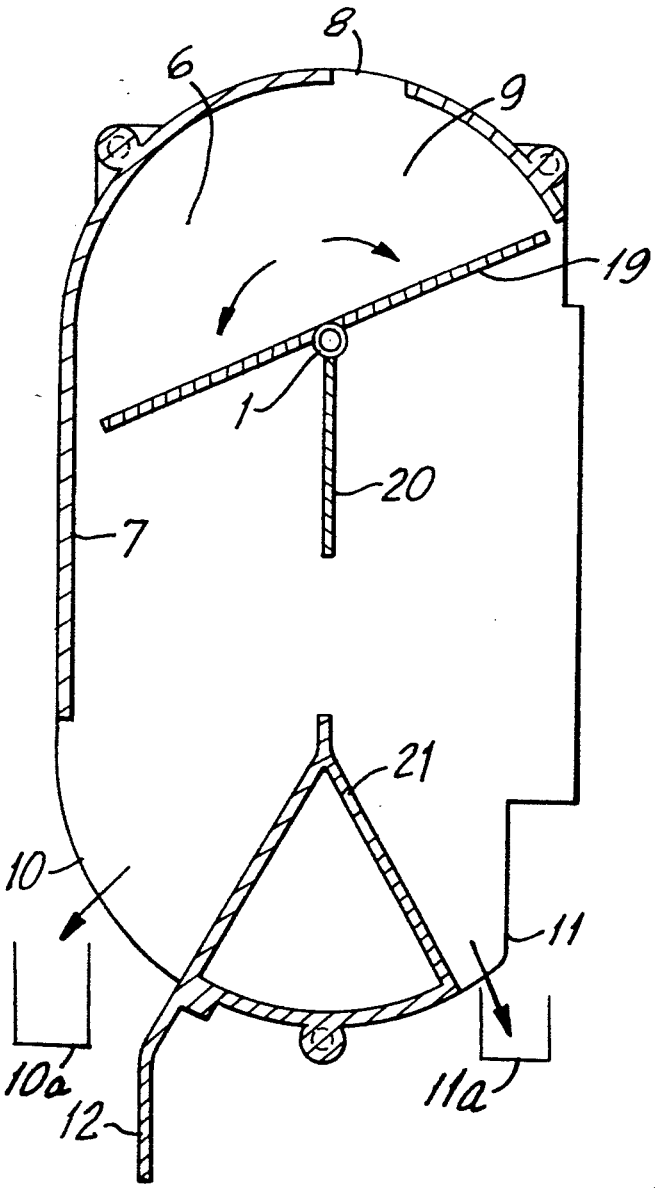
FIG. 5 is a view similar to that of FIG. 1, but for a different embodiment wherein the store is considerably simplified.
Figure 6:
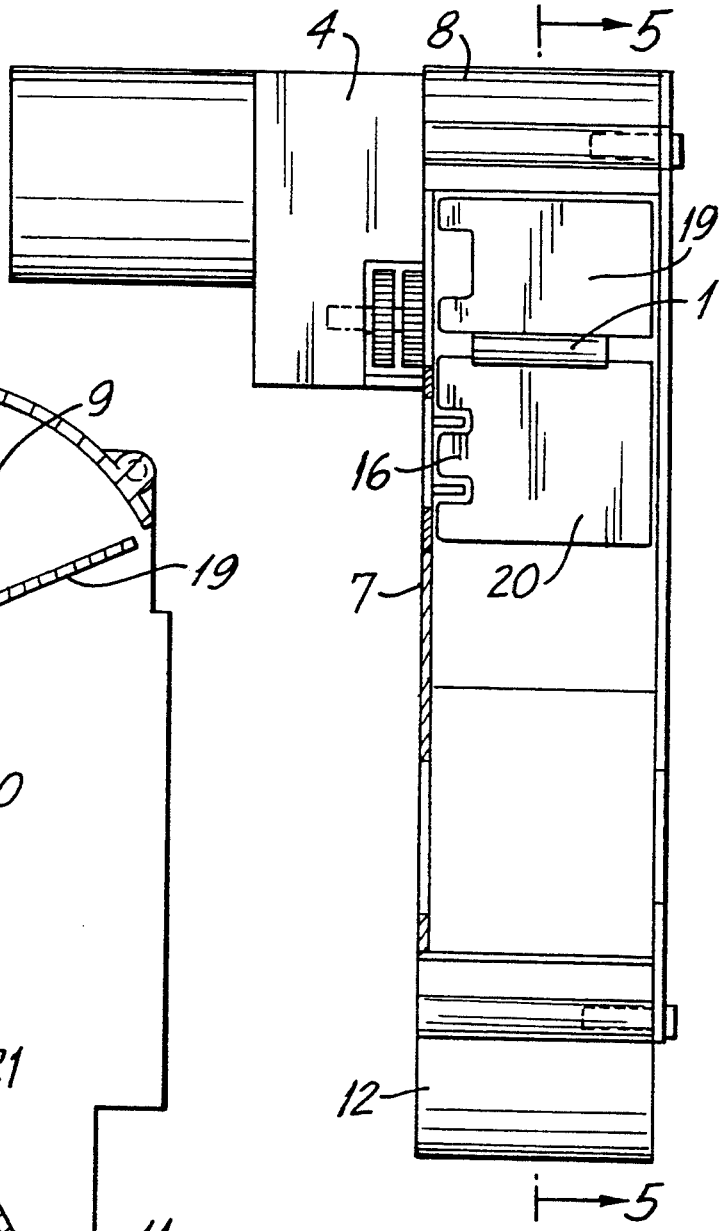
Figure 7:
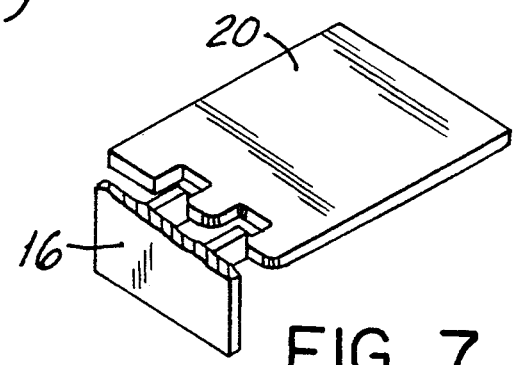
FIG. 7 is a perspective detail of the control blade, with the relevant pair of photodiodes controlling the movement of the motor-reducer in the embodiment of FIGS. 5 and 6.

In another preferred embodiment shown in FIGS. 5 to 7, the store can be substantially simplified, specifically eliminating the gear-tooth belt (3) and the blades (5) attached thereto, and the return block (2), mounting a blade or rotatory partition (19) directly upon an output shaft (11) of the motor-reducer, its spread being equal to the width of the housing (7) such that when horizontal it provides a sole vessel (6') to collect the coins inserted through the upper window (8), such that it may in this position retain all the coins inserted by a given user in expectation of the machine providing the product, and the motor-reducer group (4) will in due course turn in either direction in order for the sole vessel (6') to empty towards the evacuation window (10 ) or towards window (11), as above the, such motor-reducer group (4) is controlled also, as above, by a pair of photodiodes (16) which are in this case activated by a blade (20) which is similar to one of the blades (5) in the above case, as to the edge acting upon the pair of photodiodes (16).

Given that in this case as the number of blades (5) are not provided, there are no means to provide for lower guidance of the coins towards the windows (10) and (11), a dihedral fixed partition (21) has been provided at this area meeting such function.

As above, and upon unloading the coins in either direction, the motor-reducer group (4) will put the vessel (6') retaining the coins back in place, defining a full turn in order for the partition (19) to take up a considerably horizontal position and for the blade (20) to point down from the same.

We feel that the device has now been sufficiently described for any expert in the art to have grasped the full scope of the invention and the advantages it offers.

The materials, shape, size and layout of the elements may be altered provided that this entails no modification of the essential features of the invention.

The terms used to describe the invention herein should be taken to have a broad rather than a restrictive meaning.

I claim:

1. A temporary automatic machine coin store, comprising a vertically elongate and substantially rectangular housing with semi-cylindrically rounded ends; two tooth-gear blocks positioned within said housing upon an imaginary vertical middle plane; a motor-reducer group including a drive motor, said motor-reducing group being mounted outside said housing, one of said tooth-gear blocks being a driving block connected to said motor-reducer group to be operated thereby and another of said tooth-gear blocks being a return block vertically spaced from said driving block; a gear-tooth belt mounted between said tooth-gear block and being rotatable thereby, said belt being provided with a plurality of blades attached thereto, said blades extending at right angles to said belt at all times and defining therebetween spacings for accommodating coins inserted into said housing, said housing having at an upper end region thereof an entry window for insertion of coins by a user of the machine coin store so that as said belt with said blades are rotated by said motor-reducer group and said tooth-gear blocks, two adjacent uppermost blades which are positioned at a time below said entry window, form a dihedral into which the coins inserted through said entry window drop, and two opposed outlet windows formed in a bottom region of the housing for the coins to be ejected from said housing, said drive motor turning said belt in two opposite directions so as to selectively move said belt to one of said outlet windows depending on whether or not a machine provides the user with a product or service requested so as to send the coins to a collector box or to channel the coins back to the user.

2. A temporary automatic machine coin store according to claim 1, wherein the number of said blades is sufficient to provide a number of said spacings in accordance with the maximum number of coins to be inserted by each user; and further comprising means for fixing each blade to said belt, said means including a pair of clips mounted at two corners of each blade at a side thereof facing said belt, said belt having belt cogs, said clips being locked at said cogs, each blade having at one of outer corners thereof a projection forming a spacing abutment for said blade and limiting a maximal proximity thereof.

3. A temporary automatic machine coin store according to claim 1, and further comprising a pair of photodiodes for controlling positions of said blades, said photodiodes being mounted in said housing such that a respective blade breaks a beam of light of said photodiodes when said blade crosses said photodiodes upon rotation of said belt.

* * * * *